US007284743B1

(12) United States Patent
Brighton et al.

(10) Patent No.: US 7,284,743 B1
(45) Date of Patent: Oct. 23, 2007

(54) HOIST LIMITING SYSTEM

(75) Inventors: James J. Brighton, Grand Rapids, MI (US); Samuel J. Darling, Muskegon, MI (US); Phillip W. Kary, Muskegon, MI (US)

(73) Assignee: Columbus McKinnon Corporation, Amherst, NY (US)

( * ) Notice: Subject to any disclaimer, the term of this patent is extended or adjusted under 35 U.S.C. 154(b) by 0 days.

(21) Appl. No.: 11/592,876

(22) Filed: Nov. 3, 2006

(51) Int. Cl.
*B66D 1/48* (2006.01)

(52) U.S. Cl. ..... 254/268; 242/534; 242/563

(58) Field of Classification Search ..... 254/267, 254/268, 269, 270, 274, 275, 276; 242/534, 242/563

See application file for complete search history.

(56) References Cited

U.S. PATENT DOCUMENTS 3,922,605 A * 11/1975 Sarrell ..... 324/166
3,960,362 A * 6/1976 Griffiths et al. ..... 254/276
3,967,703 A 7/1976 Martin
4,156,467 A * 5/1979 Patton et al. ..... 173/21
4,636,962 A * 1/1987 Broyden et al. ..... 700/228
4,938,454 A 7/1990 Jones
5,492,306 A * 2/1996 Zaguroli, Jr. ..... 254/268
5,803,437 A * 9/1998 Paterson et al. ..... 254/343
6,135,421 A 10/2000 Bartelme et al.
6,547,220 B2 * 4/2003 Johnson ..... 254/331
6,966,544 B2 11/2005 McCormick et al.
7,097,155 B2 8/2006 Jackson et al.
7,219,879 B2 * 5/2007 Jackson et al. ..... 254/276

* cited by examiner

*Primary Examiner*—Emmanuel M Marcelo
(74) *Attorney, Agent, or Firm*—Phillips Lytle LLP

(57) ABSTRACT

A hoist limiting system (15) comprising a frame (16), a hoist drum (17) supported by the frame and rotatable about a hoist axis (x-x), a hoist driver (19) supported by the frame and configured to rotate the hoist drum in opposite upward (30) and downward (31) directions about the hoist axis, a hoist line (18) in engagement with the hoist drum such that the hoist line winds in the upward or downward direction in response to rotation of the hoist drum, at least one gear (20) mechanically coupling the hoist driver and hoist drum and configured to rotate about a gear axis (x-x), the gear having a face (21) that rotates about the gear axis in a upward or downward direction in response to rotation of the hoist drum, a first proximity limit switch (26) supported by the frame adjacent the rotating face such that the rotating face moves relative to the proximity switch and a second proximity limit switch (28) supported by the frame adjacent the rotating face such that the rotating face moves relative to the second proximity switch, the first and second proximity switches configured to sense the presence or absence of the face and communicating with a controller (29), the first and second proximity switches, the control unit, and the hoist driver configured to prevent the hoist drum from rotating in the upward direction as a function of signals from the first and the second proximity switches and configured and arranged to prevent the hoist drum from rotating in the downward direction as a function of the signals from the first and the second proximity switches.

10 Claims, 4 Drawing Sheets

HOIST LIMITING SYSTEM

TECHNICAL FIELD

The present invention relates generally to the field of winches or hoists and, more particular, to a hoist having a system for setting and imposing an upper and lower limit of travel.

BACKGROUND ART

Because of safety issues associated with moving heavy objects, hoisting equipment often includes safety features that limit how high or how low the loading line can travel. The desire is to limit how high the load can travel so that, for example, it is not damaged or hit by the load or the load is not moved too far in one direction. Similarly, it is often desirable to limit how low the hoist can travel. Several methods or devices are known in the prior art for achieving such hoisting limits.

U.S. Pat. No. 7,097,155 teaches a hoist that includes a device for signaling when a preset minimum number of cable windings are left on the winding drum. The device uses an optical sensor to count the number of revolutions of the drum and the direction of rotation. An alarm is activated when only the preset minimum number of winding layers remain on the drum. Because this system requires an optical sensor that keys off of windings on a drum, it does not have application across a broad number of hoists.

U.S. Pat. No. 6,966,544 also keys off of windings on the drum of a hoist, but with a proximity limit switch. A first proximity limit switch is mounted on the frame adjacent to the hoist drum and it senses the presence or the absence of the hoist rope around the drum. When it senses the presence of the hoist rope around the drum at that point, it signals a control to prevent the hoist motor from further rotating the hoist drum in the wind-on direction, thereby preventing further lifting of the load. A second proximity limit switch is positioned adjacent a second point along the drum, and it signals the control to prevent the hoist motor from further rotating the hoist drum in the wind-off direction when it senses the absence of the hoist rope, thereby preventing further lowering of the load. However, this type of configuration is difficult to adjust depending on the desired limits and also requires a winding drum.

Paddle type or block operated limit switches utilize a mechanical actuator on the hoist that activates a switch when the hoist lifting block makes physical contact with the hoist. However, this type of switch is not usually considered adjustable.

A geared limit switch is one that is typically driven by the same shaft that drives the sprocket on a chain hoist or drum on a wire rope hoist. A geared limit switch operates by counting the number of revolutions of the hoist drum, and when a threshold is met a cam or gear actuates a micro-switch and power is cut. Typically there are a pair of micro-switches, one for up or one for down. However, while a geared limit switch can be fitted with different gear ratios to accommodate various lift ranges, the adjustment becomes more sensitive as the gear ratio becomes numerically higher.

The screw type limit switch has a fine thread shaft with a pair of nuts which travel along its length. A micro switch near each end of the threaded shaft provides the limits. While the nuts are adjusted to provide the settings, this device is limited by the length of the threaded shaft.

Thus, it would be beneficial to provide a limiting device for a hoist or winch that has set points that are easily adjustable and can be used with hoists having non-winding drums or sprockets.

DISCLOSURE OF THE INVENTION

With parenthetical reference to the corresponding parts, portions or surfaces of the disclosed embodiment, merely for the purposes of illustration and not by way of limitation, the present invention provides an improved hoist apparatus (15) comprising a frame (16), a hoist drum (17) supported by the frame and rotatable about a hoist axis (x-x), a hoist driver (19) supported by the frame and configured to rotate the hoist drum in opposite upward (30) and downward (31) directions about the hoist axis, a hoist line (18) in engagement with the hoist drum such that the hoist line winds in the upward or downward direction in response to rotation of the hoist drum, at least one gear (20) mechanically coupling the hoist driver and hoist drum and configured to rotate about a gear axis (x-x), the gear having a face (21) that rotates about the gear axis in a upward or downward direction in response to rotation of the hoist drum, a first proximity limit switch (26) supported by the frame adjacent the rotating face such that the rotating face moves relative to the proximity switch and a second proximity limit switch (28) supported by the frame adjacent the rotating face such that the rotating face moves relative to the second proximity switch, the first and second proximity switches configured to sense the presence or absence of the face and communicating with a controller (29), the first and second proximity switches, the control unit, and the hoist driver configured to prevent the hoist drum from rotating in the upward direction as a function of signals from the first and the second proximity switches and configured and arranged to prevent the hoist drum from rotating in the downward direction as a function of the signals from the first and the second proximity switches.

The rotating face may comprise a positive area (35-38) and a negative area (22-25) that rotate about the gear axis in the upward or downward direction in response to rotation of the hoist driver, the first and second proximity switches supported by the frame adjacent the rotating face such that the rotating positive and negative areas move relative to the proximity switch such that the switches sense the presence of the face when adjacent the positive area and sense the absence of the face when adjacent the negative area. The negative area may comprise multiple notches in the face. The positive and the negative areas may be positioned and aligned relative to the proximity switches such that the proximity switches provide a first sequence of signals with rotation of the face in the upward direction and the proximity switches provide a second and different sequence of signals with rotation of the face in the downward direction.

The hoist line may be selected from a group consisting of wire, chain and rope. The controller may be configured and adapted to set an upper limit for rotation of the hoist drum and to set a lower limit for rotation of the hoist drum. The controller may comprise a user interface (39) for adjustably setting an upper limit and a lower limit of rotation for the hoist drum. The driver may comprise a motor and a brake (34). The hoist drum may be a sprocket.

Accordingly, the general object of the present invention is to provide a hoist in which an upper limit of travel and a lower limit of travel may be set.

Another object is to provide a hoist in which the upper and lower limits are entirely adjustable.

Another object is to provide a hoist having limits triggered by rotation in the gear train.

Another object is to provide a hoist in which the upper and lower limits may be set electronically.

Another object is to provide a hoist which limits the upper and lower vertical travel of the loads using slots or bosses in a rotating component of the hoists gear train.

Another object is to provide a hoist having limit switches that are independent of the hoist's available lift.

These and other objects and advantages will become apparent from the foregoing and ongoing written specification, the drawings, and the appended claims.

DESCRIPTION OF THE PREFERRED EMBODIMENTS

Figure 1:
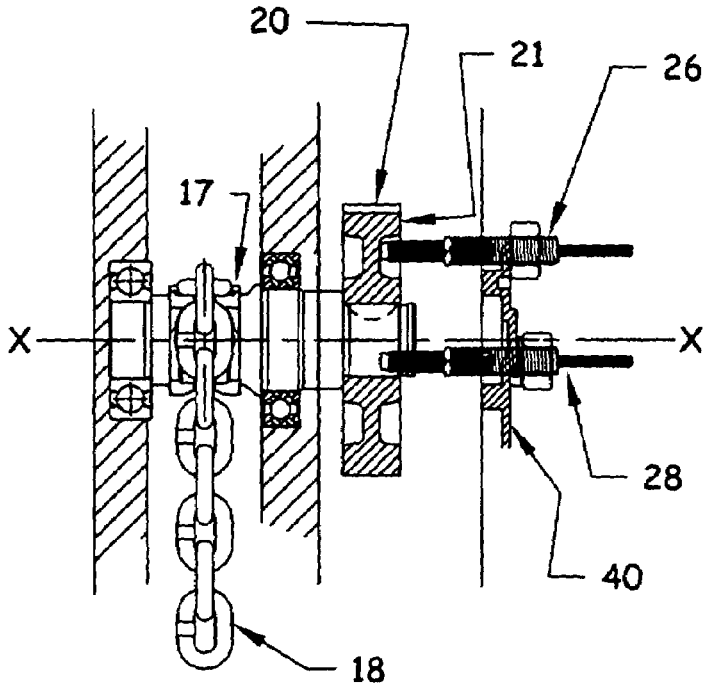
FIG. 1 is a cross sectional view of the preferred embodiment's orientation of the hoist drum, gear and proximity switches.

At the outset, it should be clearly understood that like reference numerals are intended to identify the same structural elements, portions or surfaces, consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

Figure 2:
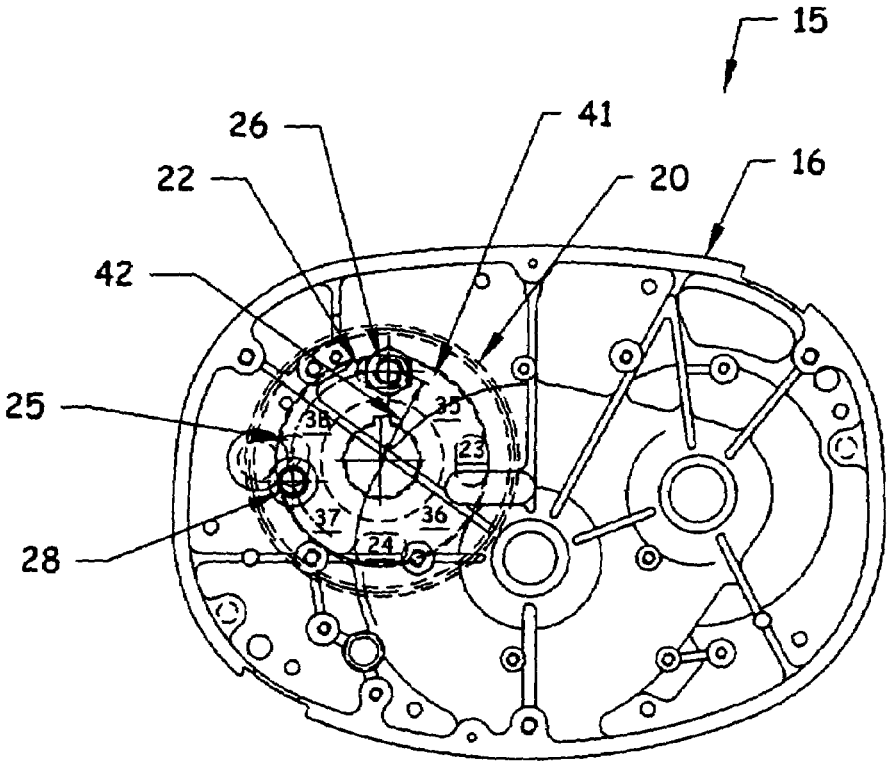
FIG. 2 is a partial vertical sectional view of the preferred embodiment hoist.

Referring now to the drawings and, more particularly to FIG. 2 thereof, this invention provides an improved hoist limiting system, of which the presently preferred embodiment is generally indicated at 15. Hoist 15 generally includes a conventional frame or housing 16, load bearing chain 18 extending over a drum or sprocket 17, a motor 19 for selectively rotating drum 17, a gear train between motor 19 and drum 17, and an AC motor brake 34.

Figure 7:
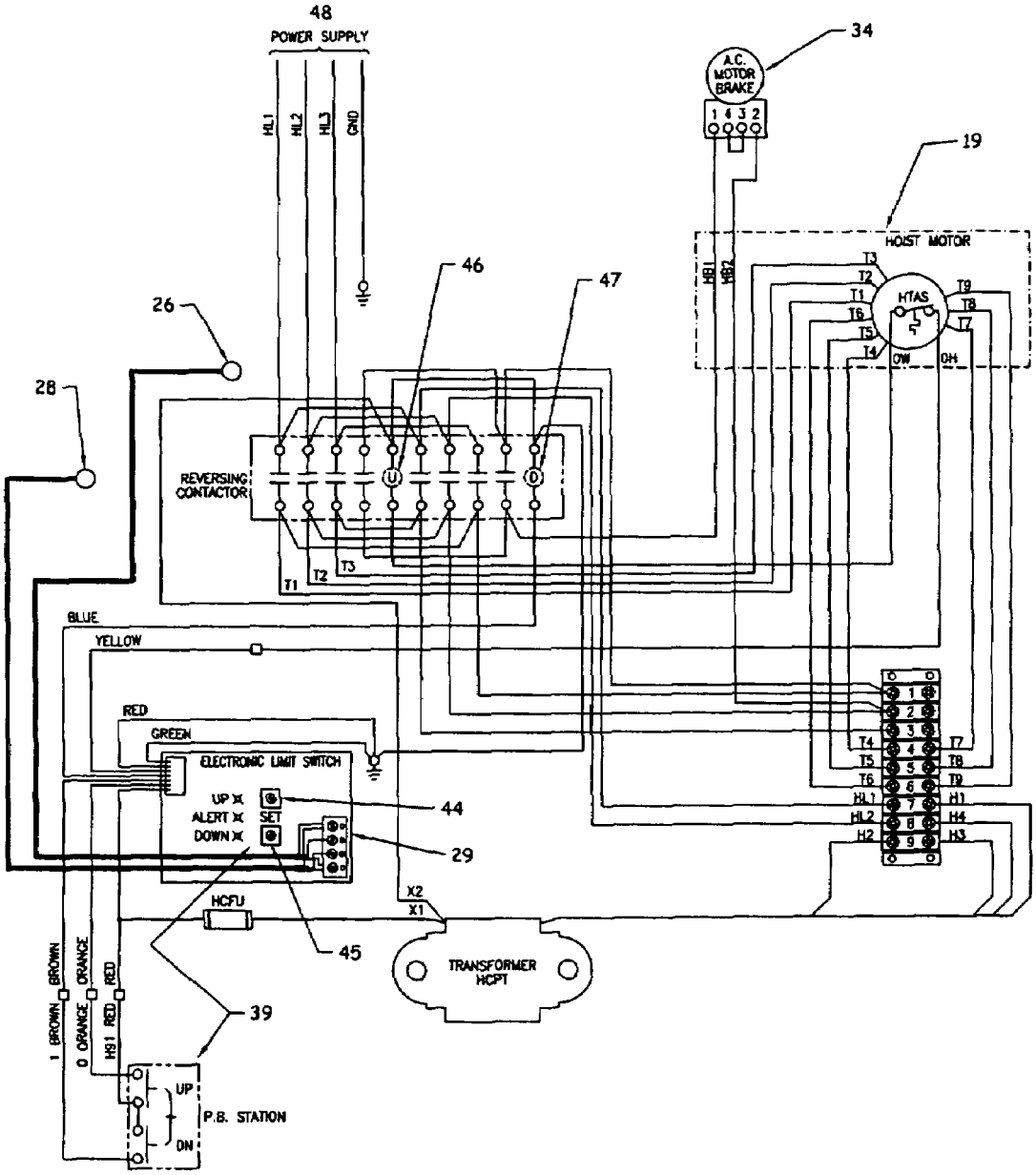
FIG. 7 is a schematic of the electronics of the hoist shown in FIG. 1.

Motor 19 is a conventional motor having one or more speeds. As shown in FIG. 7, a standard contactor control between power supply 48 and motor 19 is used to power and control the direction of motor 19. Up contactor and coil 46 powers motor 19 in upward direction 30, and down contactor and coil 47 powers motor 19 in downward direction 31. Any time there is a cut in power to motor 19, brake 34 automatically sets.

Chain 18 extends over drum 17 such that it moves, with rotation of drum 17 counterclockwise or clockwise about axis x-x, in an upward 30 or downward direction 31. In this embodiment, a chain 18 and sprocket 17 is employed, but it is contemplated that other load bearing lines may be employed, such as wire or rope, and that other types of drums may be used, such as a conventional drum around which the wire of a winch is wound-on or wound-off. Thus, the use of the term drum herein is meant to encompass and include sprockets as well as conventional rope drums.

Hoist 15 also includes a conventional forged gear train between drum 17 and motor 19. The gear train couples hoist motor 19 to hoist drum 17 and transfers the torque and speed of the hoist motor 19 output to a torque and speed that is utilized to drive hoist drum 17 and raise or lower chain 18. The output shaft of the gear train is coupled to hoist drum 17 to selectively rotate hoist drum 17 at the output torque and speed of the gear train. While a forged gear arrangement is shown, it is contemplated that other gear arrangements and ratios may be employed. For example, a billet gear arrangement may be used as an alternative.

Sprocket gear 20 in the gear train is connected to drum 17 and rotates with rotation of motor 19 and drum 17 in either the upward or downward direction. As shown, sprocket gear 20 rotates about axis x-x, as does drum or sprocket 17. As shown in FIG. 1, gear 20 has a rightwardly facing end surface 21 which rotates with drum 17 in either the upward or downward direction. Frame 16, hoist drum 17, hoist chain 18, motor brake 34, hoist motor 19 and sprocket gear 20 are generally know components in a hoist.

However, hoist 15 includes a unique limiting system. The preferred embodiment of the system includes two proximity switches 26 and 28 supported by frame 16 such that their sensing ends are adjacent to the rightwardly facing and rotating surface 21 of gear 20, as shown in FIG. 1. As shown in FIG. 7, proximity switches 26 and 28 each communicate with a controler 29, which is a component part of the hoist's control circuit shown in FIG. 7, and includes a user interface 39 with set buttons 44 and 45.

Proximity switches 26 and 28 are conventional and known proximity limit switches which are the type that is capable of sensing the presence or absence of an object or surface within one to two millimeters of its sensing end without touching the surface. The E57-08GU02-C model proximity limit switch manufactured by Cutler-Hammer may be used in the preferred embodiment.

As shown in FIG. 1, proximity switches 26 and 28 are mounted on frame 16 with a mounting bracket 40 in close proximity to face 21 of gear 20. Switches 26 and 28 are each positioned adjacent face 21 at the same radius 42 from axis x-x. Thus, they each sense the same annular portion 41 of face 21 as it rotates about axis x-x. They are also positioned so that they are not at right angles to each other. In the preferred embodiment, they are 109 degrees apart relative to axis x-x.

Proximity switches 26 and 28 provide one of two signals to control 29. They either provide an "on" signal, which indicates that they are sensing the presence of an object, or they provide an "off" signal, which indicates that they are sensing the absence of an object. Sequences of pairs of signals are recorded by control 29. When the signal from either switch changes from "on" to "off", or vice versa, a new count is recorded.

Face 21 in turn includes an annular portion 41 that rotates, generally at the same radius 42 from axis x-x as switches 26 and 28, by and adjacent to switches 26 and 28. Portion 41 has an alternating series of positive areas 35-38 and negative areas 22-25. Annular portion 41 of face 21 and switches 26 and 28 are configured and orientated such that when each of positive areas 35-38 rotate by adjacent switches 26 and 28, respectively, switches 26 and 28 register an "on" signal. Annular portion 41 of face 21 and switches 26 and 28 are also configured and orientated such that when each of negative areas 22-25 rotate by switches 26 and 28, respectively, switches 26 and 28 register an "off" signal. In the preferred embodiment, face 21 is generally a planar rightwardly-facing annular surface spaced within 2 mm from the sensing ends of switches 26 and 28 and having four elongated slots 22-25 oriented about axis x-x at right angles to each other. The center of slots 22-25 are a distance 42 from axis x-x. Slots 22-25 form the negative area of face 21 and surfaces 35-38 between slots 22-25 provide the positive area.

As shown in FIGS. 3-6, the orientation of switches 26 and 28, and the relative orientation of slots 22-25, will result in proximity switches 26 and 28 sending a sequence of signals to control 29 as gear 20 rotates about axis x-x. As shown, the rotation of face 21 in a clockwise direction 31 correlates to drum 17 moving in a downward direction and the load bearing end of chain 18 moving away from drum 17 and hoist 15. Alternatively, the rotation of face 21 in a counterclockwise direction 30 correlates to drum 17 moving in an upward direction and the load bearing end of chain 18 moving up or towards drum 17 and hoist 15. Because slots 22-25 are orientated at right angles relative to each other, and because proximity switches 26 and 28 are not at right angles, proximity switches 26 and 28 send a different sequence of signals to control unit 29 depending on whether face 21 is moving in an upward 30 or downward 31 direction. As shown, slots 22-25 are not perfectly circular but have an elongated shape. Thus, the middle of the notch is formed by opposed parallel surfaces and the ends are semicircular with a radius the same or larger than the radius of the ends of switches 26 and 28. Slots 22-25 are thus longer than the diameter of the sensing ends of proximity switches 26 and 28.

Figure 3:
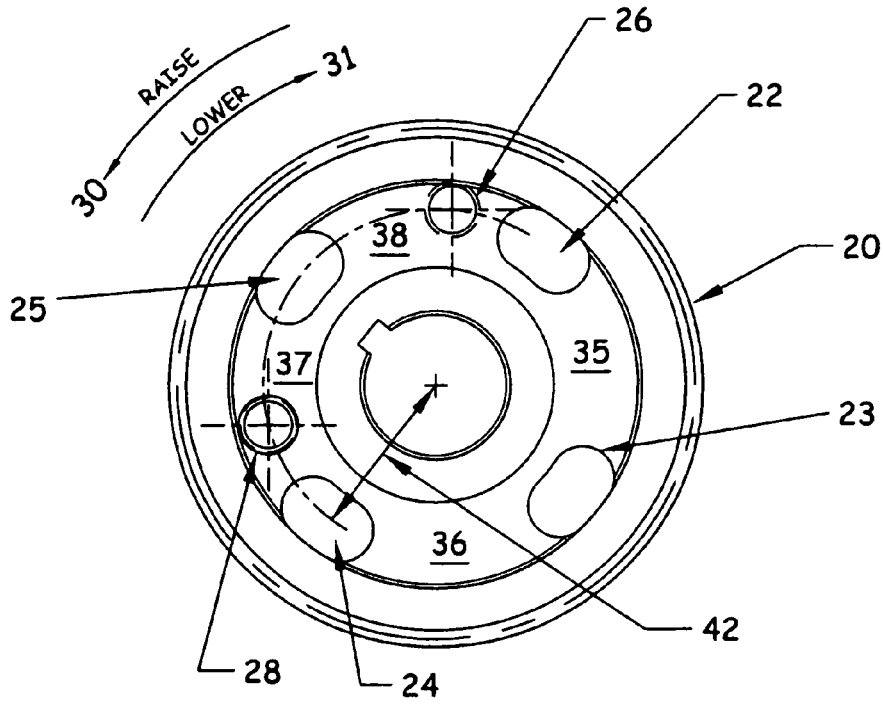
FIG. 3 is an illustration of the relative orientation of the gear end face and proximity switches shown in FIG. 1 at a first rotational position.
Figure 4:
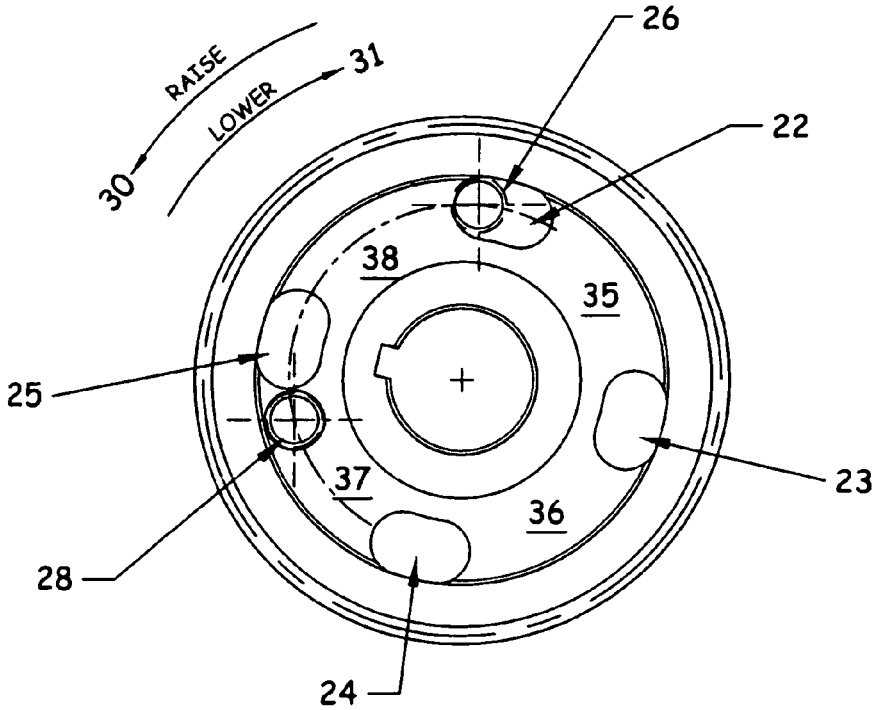
FIG. 4 is an illustration of the relative orientation of the gear end face and proximity switches shown in FIG. 1 at a second rotational position.
Figure 5:
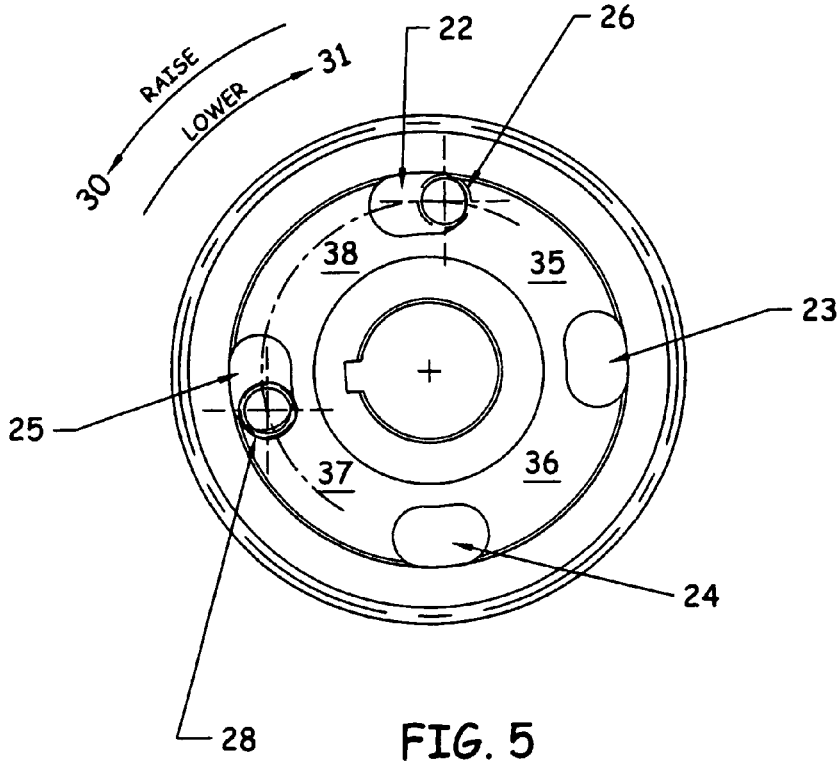
FIG. 5 is an illustration of the relative orientation of the gear end face and proximity switches shown in FIG. 1 at a third rotational location.
Figure 6:
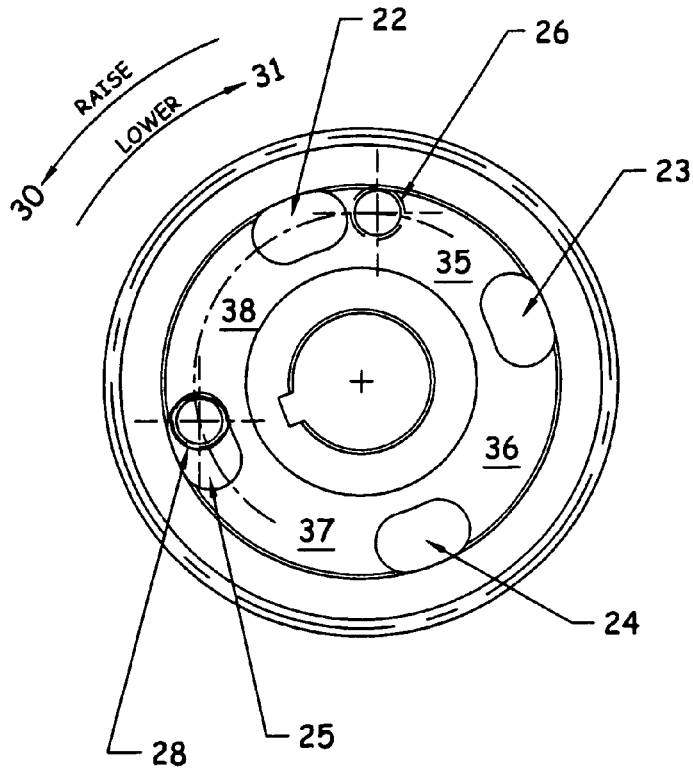
FIG. 6 is an illustration of the relative orientation of the gear end face and proximity switches shown in FIG. 1 at a fourth rotational position.

FIGS. 3-6 show the generation of a sequence of signals from switches 26 and 28 when face 21 rotates in the counterclockwise or upward direction 30. FIG. 3 shows a first signal count of "on-on", with switch 26 registering an "on" signal as it senses the presence of positive surface 38 and switch 28 registering an "on" signal as it senses the presence of positive surface 37. As shown in FIG. 4, when face 21 moves in a counterclockwise direction and the leading edge of slot 22 passes in front of switch 26, proximity switch 26 will change its signal from "on" to "off" as it senses the absence of a surface. However, at the time that proximity switch 26 sends an "off" signal, proximity switch 28 will still be sending an "on" signal because proximity switches 26 and 28 are more than 90 degrees apart, while slots 22 and 25 are only 90 degrees apart. Thus, the next count in the sequence is "off-on". With continued rotation, as shown in FIG. 5, the next count in the upward direction is "off-off". Because slot 22 is elongated and longer than the diameter of the sensing end of proximity switch 26, switch 26 is still indicating an "off" while switch 28 changes to an "off" signal as it senses the absence of a surface with the leading edge of slot 25 passing by proximity switch 28. As shown in FIG. 6, with continued rotation in a counterclockwise direction, proximity switch 26 changes to "on" with its sensing of the presence of surface 35, while proximity switch 28 continues to sense the absence of any surface as it is aligned with the trailing end of slot 25. Thus, the sequence of signals when drum 17 is rotating in an upward direction 30 as shown in FIGS. 3-6 is as follows:

| Raising Sequence | |
|---|---|
| 26 | 28 |
| On | On |
| Off | On |
| Off | Off |
| On | Off |

If drum 17 and face 21 are moving in the downward or clockwise direction 31, the sequence will differ. Using FIG. 3 as a starting point but rotating in the opposite direction, the first signal is "on-on". However, in the clockwise direction proximity switch 26 will still be sensing the presence of surface 38 when proximity switch first senses the absence of surface 37 as the leading edge of slot 24 passes by proximity switch 28. This will result in an "on-"off" signal. As the trailing edge of slot 24 approaches passing over proximity switch 28, resulting in an continued "off" signal, the leading edge of slot 25 will pass by proximity switch 26, resulting in proximity switch 26 registering the absence of surface 38. This will result in an "off"-"off" count. Next, as slot 24 passes by proximity switch 28 such that proximity switch 28 begins to register the presence of surface 36, proximity switch 26 will be aligned with the trailing end of slot 25, and therefore still registering an "off" signal. Thus, at this point the sequence changes with an "off"-"on" count. The sequence indicating that drum 17 and chain 18 are moving in the downward direction 31 is shown in the following chart.

| Lowering Sequence | |
|---|---|
| 26 | 28 |
| On | On |
| On | Off |
| Off | Off |
| Off | On |

Thus, because the sequence of signals over four counts will differ depending on whether the drum is moving in the upward or downward direction, system 15 is able to determine which way drum 17 and chain 18 are moving.

In addition, the preferred embodiment provides a check of location when the hoist is turned off and then turned back on. For example, if hoist 15 is shut-off at in "on-on" condition, control 29 will check to assure that the hoist is in that same condition when it is turned back on. However, some account for play in the gears is provided. If the reading when the hoist is turned back on has changed to "on-off", the control knows that the drum has rotated one count down, and if control 29 registers "off-on", the system has rotated one count up. However, if control 29 registers "off-off", it is not able to determine whether the gears have rotated two counts up or down, and thus the hoist is immediately shut-off until re-calibrated as described below.

Control 29 includes a user interface 39 which allows for the hoist's upper and lower limit to be easily adjusted without reference to the total travel of the hoist or requiring mechanical adjustment of the switches. As shown in FIG. 7, user interface 39 includes an up-set button 44 and a down-set button 45. User interface 39 also includes a conventional panel or remote pad for the user to control movement of the hoist up or down. Because control 29 counts sequences of signals, the upper and lower limit can be set by running the hoist between the desired upper and lower limit and using the system to count and store the number of sequence changes between those upper and lower limits, thereby calibrating the travel limits and setting a reference sequence and count for the permitted travel of chain 18. Thus, to set the upper and lower limits, the user pushes both up-set button 44 and down-set button 45 simultaneously. This sends a signal to control 29 to both zero and temporarily inactivate the sequence counter. The hoist is then operated so that the load bearing end of chain 18, which typically comprises a hook, is at the desired upper or lower limit. Assuming that the hook is moved to the desired upper limit, the user then pushes the up-set button 44. This activates the sequence counter of control 29. The user then moves the hook to the desired lower position and pushes the down-set limit button 45. Control 29 counts and records the sequence of signals between the operator's activation of the up-set button 44 and the down-set button 45 and stores this range.

The operator then operates the hoist and throughout that operation control 29 keeps track of the direction and count of signals from switches 26 and 28. If control 29 receives an aggregate upward count of signals that is greater than the selected limit when motor 19 is moving in the upward direction, control 29 sends a signal to open the hoist's contactor coil 46, thereby disconnecting power from the motor, setting brake 34 and stopping the hoist from moving beyond the preset limit. Similarly, if control 29 receives an aggregate downward count of signals when motor 19 is moving in the downward direction that would bring the hook below the lower limit, control 29 sends a signal to open contactor coil 47, thereby disconnecting power from the motor and setting brake 34. Thus, the system allows for a new method of setting an upper and lower limit on the travel which is independent of the hoist's available lift and is easily and greatly adjustable within a wide range.

The present invention contemplates that many changes and modifications may be made. Therefore, while the presently preferred form of the hoist has been shown and described, and certain modifications discussed, persons skilled in this art will readily appreciate that various additional changes and modifications may be made without departing from the spirit of the invention, as defined and differentiated by the following claims.

What is claimed is:

1. A hoist apparatus comprising:

a frame;

a hoist drum supported by said frame and rotatable about a hoist axis;

a hoist driver supported by said frame and configured to rotate said hoist drum in opposite upward and downward directions about said hoist axis;

a hoist line in engagement with said hoist drum such that said hoist line moves in said upward or downward direction in response to rotation of said hoist drum;

at least one gear mechanically coupling said hoist driver and said hoist drum and configured to rotate about a gear axis;

said gear having a face that rotates about said gear axis in a upward or downward direction in response to rotation of said hoist drum;

a first proximity limit switch supported by said frame adjacent said rotating face such that said rotating face moves relative to said proximity switch;

a second proximity limit switch supported by said frame adjacent said rotating face such that said rotating face moves relative to said second proximity switch;

said first and second proximity switches configured to sense the presence or absence of said face and communicating with a controller;

said first and second proximity switches, said controller and said hoist driver configured to prevent said hoist drum from rotating in said upward direction as a function of signals from said first and said second proximity switches and configured and arranged to prevent said hoist drum from rotating in said downward direction as a function of said signals from said first and said second proximity switches.

2. The hoist apparatus set forth in claim 1, wherein said rotating face comprises a positive area and a negative area that rotate about said gear axis in an upward or downward direction in response to rotation of said hoist driver and said first and second proximity switches are supported by said frame adjacent said rotating face such that said rotating positive and negative areas move relative to said proximity switch such that said respective switches sense the presence of said face when adjacent said positive area and sense the absence of said face when adjacent said negative area.

3. The hoist apparatus set forth in claim 1, wherein said negative area comprises multiple notches in said face.

4. The hoist apparatus set forth in claim 1, wherein said positive and said negative areas are positioned and aligned relative to said proximity switches such that said proximity switches provide a first sequence of signals with rotation of said face in said upward direction and said proximity switches provide a second and different sequence of signals with rotation of said face in said downward direction.

5. The hoist apparatus set forth in claim 1, wherein said hoist line is selected from a group consisting of wire, chain and rope.

6. The hoist apparatus set forth in claim 1, wherein said controller is configured and adapted to set an upper limit for rotation of said hoist drum.

7. The hoist apparatus set forth in claim 1, wherein said controller is adapted to set a lower limit for rotation of said hoist drum.

8. The hoist set forth in claim 1, wherein said controller comprises a user interface for adjustably setting an upper limit and a lower limit for rotation of said hoist drum.

9. The hoist set forth in claim 1, wherein said driver is a motor and comprises a brake.

10. The hoist set forth in claim 1, wherein said hoist drum is a sprocket.

* * * * *